US010209642B2

(12) United States Patent
Moriyasu et al.

(10) Patent No.: US 10,209,642 B2
(45) Date of Patent: Feb. 19, 2019

(54) CHARGE ROLLER

(71) Applicant: SYNZTEC CO., LTD., Tokyo (JP)

(72) Inventors: Yuka Moriyasu, Kanagawa (JP); Hiroshi Ogura, Kanagawa (JP); Tomohiro Murata, Kanagawa (JP)

(73) Assignee: SYNZTEC CO., LTD., Tokyo (JP)

( * ) Notice: Subject to any disclaimer, the term of this patent is extended or adjusted under 35 U.S.C. 154(b) by 0 days.

(21) Appl. No.: 15/833,293

(22) Filed: Dec. 6, 2017

(65) Prior Publication Data

US 2018/0181019 A1 Jun. 28, 2018

(30) Foreign Application Priority Data

Dec. 26, 2016 (JP) ..... 2016-252014

(51) Int. Cl.
*G03G 15/02* (2006.01)

(52) U.S. Cl.
CPC ..... *G03G 15/0233* (2013.01)

(58) Field of Classification Search
USPC ..... 399/107, 110, 115, 168, 174, 176; 492/16–18, 48, 53, 56
See application file for complete search history.

(56) References Cited

U.S. PATENT DOCUMENTS 6,001,454 A * 12/1999 Murata ..... G03G 15/0233 399/176
6,558,781 B1 * 5/2003 Fuei ..... G03G 15/0233 399/149
9,280,079 B1 * 3/2016 Hoshio ..... G03G 15/0233

FOREIGN PATENT DOCUMENTS

WO WO 2012/046862 4/2012

* cited by examiner

*Primary Examiner* — Hoan Tran
(74) *Attorney, Agent, or Firm* — Young & Thompson

(57) ABSTRACT

A charge roller in an image-forming apparatus of a DC electrification mode mitigates occurrence of black lines and prevents fogging. The charge roller has a core, an elastic layer on the core, and a surface treatment layer on the surface of the elastic layer. The elastic layer is a vulcanized rubber composition containing a rubber base mainly containing an epichlorohydrin-based rubber, and additives including a conductivity-imparting agent, an inorganic filler, a vulcanization accelerator, and a vulcanizing agent. The ratio of the conductivity-imparting agent and the inorganic filler, to the entire rubber composition, is 11 mass % or less. The surface treatment layer is formed by impregnating the elastic layer with a surface treatment liquid prepared by dissolving an isocyanate compound in an organic solvent. The roller has a roller surface roughness Rz of 10 μm or less.

6 Claims, 2 Drawing Sheets

CHARGE ROLLER

The entire disclosure of Japanese Patent Application No. 2016-252014 filed on Dec. 26, 2016 is expressly incorporated by reference herein.

BACKGROUND OF THE INVENTION

Field of the Invention

The present invention relates to a charge roller employed for uniformly electrifying a photoreceptor or the like of an electrophotographic image-forming apparatus (e.g., a copying machine, a printer, or a facsimile (FAX)) of a DC electrification mode.

Background Art

In recent years, electrophotographic image-forming apparatuses employ a contact electrification mode, in which a photoreceptor or the like is electrified through contact with a roller-form or blade-form charge-imparting member (e.g., a charge roller). One specific mode of the contact electrification mode is an AC electrification mode, in which a photoreceptor or the like is electrified by applying a DC-AC multiple voltage to a change-imparting member. The other specific mode is a DC electrification mode, in which a photoreceptor or the like is electrified by applying only a DC voltage to a change-imparting member.

In the AC electrification mode, the surface of a photoreceptor or the like can be more uniformly electrified by virtue of AC voltage application, as compared with the DC electrification mode. However, electric discharge onto the photoreceptor or the like increases, and the surface thereof is damaged, to thereby shorten the service life of the photoreceptor or the like. The AC electrification mode, which employs an AC power source, suffers from high initial cost and running cost, as compared with the DC electrification mode. Meanwhile, the DC electrification mode can provide a photoreceptor or the like with poor uniformity in surface potential (charging unevenness), as compared with the AC electrification mode. More specifically, charge unevenness in the transverse direction (i.e., the direction normal to the circumferential direction of the photoreceptor or the like) is caused by lack of uniformity in surface potential (charging uniformity) of the photoreceptor or the like. The unevenness is sometimes called a crosswise line or a black line. Conceivably, the unevenness is caused by electrification of a charge gap portion (microvoids) on the upstream side of the photoreceptor or the like, resulting in separating discharge between the photoreceptor or the like and the charge-imparting member.

In order to solve the problematic unevenness in charge, gap control (particularly controlling the gap between the photoreceptor and the charge roller) has been considered. Thus, there has been proposed a method for mitigating occurrence of black lines by controlling the surface roughness of a charge roller (hereinafter referred to as a "roller surface roughness"). Roller surface roughness is controlled by, for example, polishing, use of a coating agent containing abrasives, etc. (see, for example, Patent Document 1). When the roller surface roughness is reduced by the above technique, discharge predominates at a portion in the vicinity of a nip portion, and discharge at the nip portion itself decreases. As a result, the number of discharge points decreases, to thereby generate black lines due to very small unevenness in electric resistance of the charge roller. In contrast, when the roller surface roughness increases, discharge increases at a portion in the vicinity of the nip portion and at the nip portion itself. As a result, the number of discharge points increases, and very small unevenness in electric resistance of the charge roller is cancelled, whereby occurrence of black lines can be mitigated.

Patent Document 1: WO 2012/046862

As described above, in a charge roller, occurrence of black lines can be mitigated by increasing the roller surface roughness. However, the difference in surface potential of the charge roller increases due to an increase in roller surface roughness. In this case, the potential at a photoreceptor contact portion becomes insufficient, to thereby generate "fogging." The term "fogging" refers to a phenomenon that a toner-developed image is provided on a non-image area other than the image area due to incomplete removal of electric charges accumulated on a development roller.

SUMMARY OF THE INVENTION

The present invention has been conceived under such circumstances. Thus, an object of the invention is to provide a charge roller employed in an image-forming apparatus of a DC electrification mode, which roller can mitigate occurrence of black lines and prevent fogging.

In a first mode of the present invention, there is provided a charge roller to be employed in an image-forming apparatus of a DC electrification mode, the charge roller comprising a core, an elastic layer on the core, and a surface treatment layer on the surface of the elastic layer, wherein:

the elastic layer is formed of a vulcanization product of a rubber composition comprising a rubber base mainly containing an epichlorohydrin-based rubber, and additives including a conductivity-imparting agent, an inorganic filler, a vulcanization accelerator, and a vulcanizing agent;

the ratio of the amounts of the conductivity-imparting agent and the inorganic filler, based on the entire amount of the rubber composition, is 11 mass % or lower;

the surface treatment layer is formed by impregnating the elastic layer with a surface treatment liquid prepared by dissolving an isocyanate compound in an organic solvent; and the roller has a roller surface roughness Rz of 10 μm or less.

A second mode of the present invention is directed to a specific embodiment of the charge roller of the first mode, wherein the surface treatment layer has an impregnation depth of 100 μm or less, the impregnation depth being a depth of impregnation of the elastic layer with the surface treatment liquid after impregnation of the elastic layer with the surface treatment liquid.

A third mode of the present invention is directed to a specific embodiment of the charge roller of the second mode, wherein the elastic layer exhibits the difference in electric resistance of 0.60 Log Ω to 2.40 Log Ω, before and after a surface treatment with the surface treatment liquid.

A fourth mode of the present invention is directed to a specific embodiment of the charge roller of any of the first to third modes, wherein the ratio of the amounts of the conductivity-imparting agent and the inorganic filler, based on the entire amount of the rubber composition, is 3 mass % to 11 mass %.

The present invention can provide a charge roller employed in an image-forming apparatus of a DC electrification mode, which roller can mitigate occurrence of black lines and prevent fogging.

BRIEF DESCRIPTION OF THE DRAWINGS

Various other objects, features, and many of the attendant advantages of the present invention will be readily appreciated as the same becomes better understood with reference to the following detailed description of the preferred embodiments when considered in connection with the accompanying drawings, in which.

DETAILED DESCRIPTION OF PREFERRED EMBODIMENTS

Specific embodiment of the present invention will next be described in detail with reference to drawings. Such embodiments are given for the purpose of illustration, and the present invention may be arbitrarily modified, so long as the modification falls within the scope of the present invention. In each drawing, constituent elements; i.e., the shape and dimensions of each member, the thickness of each layer, relative positional relationship, repeating units, etc. may be drawn in an exaggerated manner, for the purpose of illustrating the present invention. Furthermore, the preposition "on" in the description does not refer limitedly to "directly on." For example, expressions such as "an elastic layer on the core" and "a surface treatment layer on the elastic layer" do not exclude the cases in which another element intervenes between the core and the elastic layer or between the elastic layer and the surface treatment layer.

Figure 1:
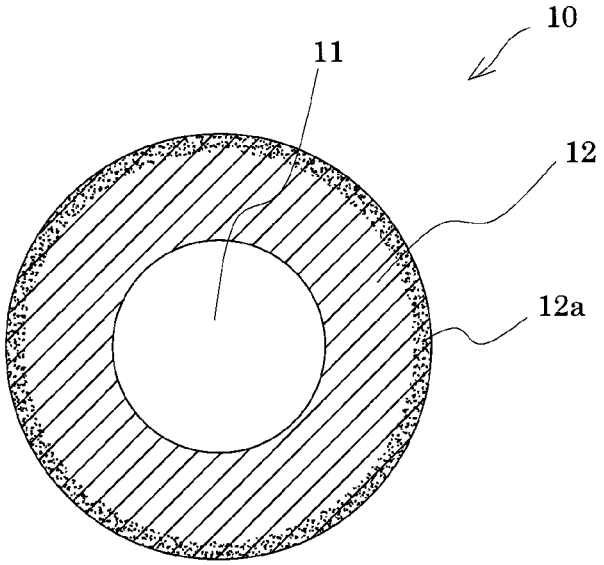
FIG. 1 is a schematic cross-section of the configuration of the charge roller according to an embodiment.

FIG. 1 is a schematic cross-section of the configuration of the charge roller according to the embodiment. As shown in FIG. 1, a charge roller 10 has a core 11, and an elastic layer 12 provided on the core 11. The elastic layer 12 is formed of a rubber base mainly formed of an epichlorohydrin-based rubber. On the surface of the elastic layer 12, a surface treatment layer 12*a* is provided. Although not illustrated, the charge roller 10 may have one or more additional layers under the elastic layer 12.

The core 11 is made of a metallic or resin material which has excellent thermal conductivity and mechanical strength. No particular limitation is imposed on the material of the core 11, and metallic materials such as SUS alloy, nickel (Ni), nickel alloy, iron (Fe), magnetic stainless steel, cobalt-nickel (Co—Ni) alloy, and resin materials such as polyimide (PI) resin may be used. Also, no particular limitation is imposed on the shape of the core 11. The core 11 may be hollow or non-hollow. In the embodiment, the core 11 is a metallic core.

The elastic layer 12 is formed through the following procedure. Firstly, to a rubber base (a rubber elastic body), additives including a conductivity-imparting agent, an inorganic filler, a vulcanization accelerator, a vulcanizing agent, etc. are added, to thereby prepare a rubber composition. The rubber composition is vulcanized. The thus-prepared vulcanization product is molded to a layer piece having dimensions of interest. Examples of the rubber base material include polyurethane rubber (PUR), epichlorohydrin rubber (ECO), nitrile rubber (NBR), styrene rubber (SBR), and chloroprene rubber (CR). In the embodiment, epichlorohydrin rubber is used.

Examples of the inorganic filler include silica (white carbon), calcium carbonate, magnesium carbonate, clay, talc, zeolite, alumina, barium sulfate, aluminum sulfate, zinc oxide, magnesium oxide, and titanium oxide. When added to the rubber base, the inorganic filler can provide the rubber product with the below-mentioned appropriate hardness (micro rubber hardness). When no inorganic filler is used, kneadability of the rubber composition is impaired, and the roller cannot completely be polished, which is not preferred. In the embodiment, zinc oxide is used.

Examples of the conductivity-imparting agent include electron conductivity-imparting materials such as carbon black and metal powder; and ion conductivity-imparting materials such as amine complex salts, perchlorate salts, bromate salts, iodate salts, carboxylate salts, sulfonate salts, sulfate salts, and acetate salts of a metal (e.g., lithium (Li), sodium (Na), potassium (K), calcium (Ca), or magnesium (Mg)). Of these, metal amine complexes and lithium perchlorate are preferably used. The conductivity of the elastic layer 12 is preferably adjusted to about $1\times10^{5}$ Ω·cm to about $1\times10^{10}$ Ω·cm, through addition of any of the above conductivity-imparting agents. In the embodiment, carbon black and the aforementioned metal amine complex salts are used.

No particular limitation is imposed on the vulcanizing agent, and any known vulcanizing agent may be used. Examples of such vulcanizing agents include sulfur and peroxides. In accordance with needs, the rubber composition may further contain a vulcanization accelerator (a vulcanization aid) or a similar agent, which accelerates the effect of the vulcanizing agent. Examples of the vulcanization accelerator include inorganic agents such as zinc oxide and magnesium oxide; and organic agents such as thiourea, stearic acid, and amines. Alternatively, a thiazole-based vulcanization accelerator may be used for shortening vulcanization time. In the embodiment, sulfur and thiourea are used as vulcanizing agents.

In formation of the elastic layer 12, other additives such as a process aid, a foaming agent, and a foaming aid may be used in accordance with needs. These additives are not particularly limited. For example, a process aid may be used instead of the inorganic filler. The inorganic filler and a process aid may be used in combination. Examples of the process aid include higher fatty acids, fatty acid metal salts, fatty acid esters, fatty acid amides, and a plasticizer. Through addition of any of the above process aids, the adhesiveness of the rubber base is reduced, whereby formation of rollers can be facilitated. In the embodiment, stearic acid is used as a process aid. Notably, the presence of unavoidable impurities in the rubber composition of the embodiment is allowable. The amounts of these impurities are included in the total amount of other additives.

After addition of the additives, the provided rubber composition preferably has a ratio of the amounts of the conductivity-imparting agent and the inorganic filler to the entire amount of the rubber composition is 11 mass % or less, more preferably 3 mass % to 11 mass %. When the ratio is less than 3 mass %, processability to form the charge roller 10, in particular, kneadability of the rubber material, is impaired. When the ratio is in excess of 11 mass %, an image-forming apparatus employing the charge roller 10 problematically provides image failure, in particular, black lines. Needless to say, both cases are not preferred. Notably, when the additives such as a process aid are incorporated, the aforementioned ratio is defined as the ratio of the total amount of the conductivity-imparting agent, the inorganic filler, and the additives including a process aid, with respect to the entire amount of the rubber composition.

Through vulcanizing and molding the thus-prepared rubber composition, the elastic layer 12 having a rubber hardness (micro rubber hardness) of 40° or higher is formed.

When the rubber hardness of the elastic layer 12 is lower than 40°, polishability during polishing the roller is problematically impaired.

No particular limitation is imposed on the method of forming the elastic layer 12. However, since the rubber composition attains suitable flow in a metal mold by virtue of the aforementioned components contained therein, the composition can be suitably formed with a metal mold. In one specific procedure of the method of forming the elastic layer 12, the rubber composition is transfer-molded or injected-molded by means of a mirror-polished metal mold, to thereby form the elastic layer 12. In another specific procedure, the elastic layer is formed directly on the core 11 through press molding, and the surface of the elastic layer 12 is optionally polished.

The surface treatment layer 12*a* is formed through an impregnation treatment. Specifically, the surface of the elastic layer 12 is impregnated with a surface treatment liquid prepared by dissolving an isocyanate compound in an organic solvent. In the thus-formed surface treatment layer 12*a*, the surface treatment liquid has been completely incorporated into the layer via impregnation such that the surface treatment liquid concentration gradually decreases from the surface to the inside. The surface treatment layer 12*a* formed on the elastic layer 12 can prevent transfer of undesirable substances such as a plasticizer to the surface of the charge roller 10. Thus, the charge roller 10 exhibits excellent anti-staining performance to a photoreceptor (not illustrated) or the like.

Examples of the isocyanate compound include 2,6-tolylene diisocyanate (TDI), 4,4'-diphenylmethane diisocyanate (MDI), p-phenylene diisocyanate (PPDI), 1,5-naphthalene diisocyanate (NDI), 3,3-dimethyldiphenyl-4,4'-diisocyanate (TODI), and oligomers and modified products thereof. No particular limitation is imposed on the organic solvent which dissolves the isocyanate compound. Examples of the organic solvent include ethyl acetate, methyl ethyl ketone (MEK), and toluene.

The surface treatment liquid preferably has an isocyanate compound content, based on the entire amount of the surface treatment liquid, of 6 mass % to 34 mass %, more preferably 10 mass % to 30 mass %. When the isocyanate compound content, based on the entire amount of the surface treatment liquid, is less than 6 mass %, the difference in electric resistance, before and after the below-mentioned surface treatment, is less than 0.60 Log Ω. In this case, black lines are generated in the printed images (i.e., poor image score). Also, when the isocyanate compound content, based on the entire amount of the surface treatment liquid, is in excess of 34 mass %, the difference in electric resistance, before and after a surface treatment, is in excess of 2.40 Log Ω. In this case, unevenness in tint of the printed image occurs. Needless to say, both cases are not preferred.

The surface treatment liquid may further contain a resin. Examples of the resin include one or more members selected from acrylic fluororesins and acrylic silicone resins. Such acrylic fluororesins and acrylic silicone resins can be dissolved in a specific organic solvent and react with an isocyanate compound, to thereby form a chemical bond. The acrylic fluororesins are solvent-soluble fluororesins having a hydroxyl group, an alkyl group, a carboxyl group, or the like. Examples thereof include a block copolymer of an acrylate ester and a fluoroalkyl acrylate, and derivatives thereof. The acrylic silicone resins are solvent-soluble silicone resins. Examples thereof include a block copolymer of an acrylate ester and a siloxane acrylate ester, and derivatives thereof. These resins may be used singly or in combination of two or more species. The resin content of the surface treatment liquid is preferably 1 mass % to 30 mass %, with respect to the isocyanate component. When the resin content of the surface treatment liquid is less than 1 mass %, a target effect of preventing staining caused by deposition of an external additive or the like (e.g., toner) is reduced, whereas when the resin content is in excess of 30 mass %, unevenness in electric resistance of the surface layer increases, failing to attain uniform images. When the relative amount of the isocyanate component decreases, difficulty is encountered in formation of the effective surface treatment layer 12*a*.

Notably, no particular limitation is imposed on the method for impregnating the elastic layer 12 with the surface treatment liquid. In one method, the elastic layer 12 is immersed in the surface treatment liquid. Alternatively, the surface treatment liquid is applied onto the elastic layer 12 via spraying or a similar technique. The period of time of immersing the elastic layer 12 in the surface treatment liquid, the time of application of spraying, and the amount of the surface treatment liquid may be appropriately tuned. In a particularly preferred mode, the surface treatment layer 12*a* is formed by impregnating the elastic layer 12 with the surface treatment liquid and then curing the liquid. In the embodiment, the depth of surface treatment liquid impregnation of the elastic layer 12 is preferably 100 μm or less. Particularly, the impregnation depth is preferably 50 μm to 100 μm, from the viewpoint of durability of the elastic layer 12.

When the elastic layer 12 has the surface treatment layer 12*a* on the surface thereof, the releasability of the charge roller 10; i.e., performance of preventing deposition of a toner component or the like, can be remarkably enhanced, to thereby provide the charge roller 10 with anti-staining property. A conceivable reason for this is that crystals of components which are solid at ambient temperature (e.g., fluorine and silicone) are readily deposited onto the surface of the charge roller 10 during drying by heat. Furthermore, through crystallization of ambient temperature solid components, the effect of preventing staining substances from bleeding to the surface of the charge roller 10 can be attained. That is, bleeding of the staining substances can be effectively blocked. In other words, in the charge roller 10 of the present invention having the surface treatment layer 12*a* on the elastic layer 12, bleeding of the plasticizer added to the elastic layer 12 to the surface of the charge roller 10 can be prevented.

As described above, the elastic layer 12 of the charge roller 10 has a rubber hardness (micro rubber hardness) of 40° or higher. Even when the surface treatment layer 12*a* is provided on the elastic layer 12, the rubber hardness is substantially unchanged. That is, the rubber hardness of the surface layer (i.e., the surface treatment layer 12*a* provided on the elastic layer 12) of the charge roller 10 is 40° or higher.

After formation of the surface treatment layer 12*a*, the charge roller 10 preferably exhibits a roller surface roughness Rz (μm) of 10 μm or less. When the roller surface roughness Rz is in excess of 10 μm, fogging occurs in the image, thereby impairing image quality.

Also, the charge roller 10 preferably exhibits a difference in electric resistance, before and after formation of the surface treatment layer 12*a*, of 0.60 Log Ω to 2.40 Log Ω. The difference in electric resistance (hereinafter may be referred to as electric resistance difference) is measured under application of a DC voltage of 100 V. When the electric resistance difference is less than 0.60 Log Ω, black lines are generated in the printed images (i.e., poor image score). When the electric resistance difference is in excess of 2.40 Log Ω, unevenness in tint of the printed image occurs. Needless to say, both cases are not preferred.

The aforementioned electric resistance difference $R_{a-b}$ (Log Ω), before and after formation of the surface treatment layer 12*a*, is calculated through the following formula (1):

$$R_{a-b}=R_{after}-R_{before} \quad (1)$$

(wherein $R_{before}$ represents a common logarithmic value (Log Ω) of the electric resistance (Ω) of the charge roller 10, before formation of the surface treatment layer 12*a*; and $R_{after}$ represents a common logarithmic value (Log Ω) of the electric resistance (Ω) of the charge roller 10, after formation of the surface treatment layer 12*a*).

The compression set (%) of the charge roller 10 (after 22 hours at 70° C. and 25% compression) is preferably 40% or lower. When the compression set is in excess of 40%, the roller surface is provided with undesired grooves.

The charge roller 10, which is the above embodiment of the present invention and has the aforementioned structure and properties, is suitably employed as a charge-imparting member for electrifying a photoreceptor or the like of an image-forming apparatus of a DC electrification mode, wherein only DC voltage is applied to the charge-imparting member.

EXAMPLES

The present invention will next be described in detail by way of examples, which should not be construed as limiting the invention thereto.

Sample 1

<Production of Roller Body>

A rubber composition, mainly containing a rubber base with additives including a conductivity-imparting agent, an inorganic filler, a vulcanization accelerator, and a vulcanizing agent, was kneaded by means of a roller mixer and press-formed onto a metallic core (diameter: 6 mm), to thereby produce a roller product having an elastic layer on the metallic core. To prepare the rubber composition, an epichlorohydrin rubber was used as a rubber base; carbon black and a metal ammonium complex salt were used as conductivity-imparting agents; zinc oxide was used as an inorganic filler; and thiourea and sulfur were used as vulcanizing agents. Table 1 below shows the ratio of the amount of rubber base to the entire amount of additives (mass %) in the rubber composition, the contents (mass %) of the processing aid, charge-imparting agent, and inorganic filler, in the entire amount of the rubber composition. Notably, additive d (denominated as d) refers to other additives contained in the rubber compositions (see Table 1) other than additives a to c. Actually, sample 1 contained stearic acid as a processing aid included in additive d.

<Polishing of Roller Product>

Each of the produced roller products was polished with an abrasive stone (i.e., dry polishing) and then polished under wet conditions, to thereby form a product having dimensions of interest. The roller surface roughness Rz (μm) of each piece was adjusted to a value shown in Table 1.

<Preparation of Surface Treatment Liquid>

The composition of the surface treatment liquid (mass %) was adjusted, such that the electric resistance difference shown in Table 1 ($R_{a-b}$ (Log Ω)) was attained, before and after the surface treatment. Specifically, an isocyanate compound (MDI) (12.5 mass %) and ethyl acetate serving as an organic solvent (87.5 mass %) were mixed for 1 hour by means of a ball mill so as to prepare a dispersion, to thereby yield a surface treatment liquid of interest.

<Surface Treatment of Roller Product>

The thus-prepared surface treatment liquid was maintained at 20° C., and the above-polished roller product was immersed in the liquid for 30 seconds. Subsequently, the resultant roller product was heated for 10 hours in an oven maintained at 100° C., to thereby form a surface treatment layer on the surface of the elastic layer. The thus-produced charge roller was employed as sample 1.

Sample 2

As shown in Table 1, the procedure of producing sample 1 was repeated, except that the isocyanate compound content and the organic solvent content of the surface treatment liquid of sample 1 were changed to 15.0 mass % and 85.0 mass %, respectively, and the roller surface roughness Rz was changed to 3.0 μm, to thereby yield a charge roller. The charge roller was employed as sample 2.

Sample 3

As shown in Table 1, the procedure of producing sample 1 was repeated, except that the isocyanate compound content and the organic solvent content of the surface treatment liquid of sample 1 were changed to 15.0 mass % and 85.0 mass %, respectively, and the roller surface roughness Rz was changed to 4.6 μm, to thereby yield a charge roller. The charge roller was employed as sample 3.

Sample 4

As shown in Table 1, the procedure of producing sample 1 was repeated, except that the ratio of the total amount of the processing aid, conductivity-imparting agent, and inorganic filler, based on the entire amount of the rubber composition, was changed to 6.13 mass %, and the roller surface roughness Rz was changed to 5.3 μm, to thereby yield a charge roller. The charge roller was employed as sample 4.

Sample 5

As shown in Table 1, the procedure of producing sample 1 was repeated, except that the isocyanate compound content and the organic solvent content of the surface treatment liquid of sample 1 were changed to 10.0 mass % and 90.0 mass %, respectively, a polished roller product was immersed in the surface treatment liquid for 30 seconds and the roller surface roughness Rz was changed to 9.7 μm, to thereby yield a charge roller. The charge roller was employed as sample 5.

Sample 6

As shown in Table 1, the procedure of producing sample 1 was repeated, except that the isocyanate compound content and the organic solvent content of the surface treatment liquid of sample 1 were changed to 28.0 mass % and 72.0 mass %, respectively, and the roller surface roughness Rz was changed to 10.0 μm, to thereby yield a charge roller. The charge roller was employed as sample 6.

Sample 7

As shown in Table 1, the procedure of producing sample 1 was repeated, except that the rubber base content was changed to 86.21 mass %, and the ratio of the total amount of the processing aid, conductivity-imparting agent, and inorganic filler, based on the entire amount of the rubber composition, was changed to 10.17 mass %. The thus-polished roller product was immersed in the surface treatment liquid for 30 seconds, to thereby adjust the roller surface roughness Rz to 5.3 μm, whereby a charge roller is produced. The charge roller was employed as sample 7.

TABLE 1

| | | | | S1 | S2 | S3 | S4 | S5 | S6 | S7 |
|---|---|---|---|---|---|---|---|---|---|---|
| Rubber composition (mass %) | | | Rubber base | 90.09 | 90.09 | 90.09 | 90.09 | 90.09 | 90.09 | 86.21 |
| | Additives | a | Conductivity-imparting agent | 2.52 | 2.52 | 2.52 | 0.72 | 2.52 | 2.52 | 5.00 |
| | | b | Inorganic filler | 4.50 | 4.50 | 4.50 | 4.77 | 4.50 | 4.50 | 4.57 |
| | | c | Vulcanizing agent & aid | 2.70 | 2.70 | 2.70 | 3.78 | 2.70 | 2.70 | 3.62 |
| | | d | Others | 0.18 | 0.18 | 0.18 | 0.63 | 0.18 | 0.18 | 0.60 |
| | Ratio of additives a, b, and d (mass %) | | | 7.21 | 7.21 | 7.21 | 6.13 | 7.21 | 7.21 | 10.17 |
| Surf. treatment liquid (mass %) | Isocyanate compound | | | 12.5 | 15.0 | 15.0 | 12.5 | 10.0 | 28.0 | 12.5 |
| | Organic solvent | | | 87.5 | 85.0 | 85.0 | 87.5 | 90.0 | 72.0 | 87.5 |
| Results | Elec. resistance $R_{before}$ (LogΩ) | | | 4.90 | 4.90 | 4.90 | 4.99 | 4.90 | 4.90 | 4.99 |
| | Elec. resistance $R_{after}$ (LogΩ) | | | 5.78 | 5.98 | 5.99 | 5.61 | 5.78 | 7.25 | 5.80 |
| | Difference $R_{a-b}$ (LogΩ) | | | 0.88 | 1.08 | 1.09 | 0.62 | 0.88 | 2.35 | 0.81 |
| | Impregnation depth (μm) | | | 60 | 60 | 60 | 60 | 50 | 60 | 70 |
| | Roller surface roughness Rz (μm) | | | 8.4 | 3.0 | 4.6 | 5.3 | 9.7 | 10.0 | 5.3 |
| | Elastic layer hardness (°) | | | 48 | 48 | 48 | 48 | 48 | 48 | 50 |
| | Compression set (%) | | | 10 | 10 | 10 | 20 | 10 | 10 | 20 |
| | Fogging | | | ○ | ○ | ○ | ○ | ○ | ○ | ○ |
| | Black line | | | ○ | ○ | ○ | ○ | ○ | ○ | ○ |
| | Uneven tint | | | ○ | ○ | ○ | ○ | ○ | ○ | ○ |
| | Processability (polishing, kneading) | | | ○ | ○ | ○ | ○ | ○ | ○ | ○ |

Sn: sample n

Samples 8 to 11

As shown in Table 2, the procedure of producing sample 1 was repeated, except that the rubber base content was changed to 57.47 mass %, 73.48 mass %, 82.64 mass %, and 94.34 mass %, respectively, and the ratio of the total amount of the processing aid, conductivity-imparting agent, and inorganic filler, based on the entire amount of the rubber composition, was changed to 39.66 mass %, 25.06 mass %, 13.88 mass %, and 2.83 mass %, respectively. Each of the thus-polished rollers was immersed in the surface treatment liquid for 30 seconds, to thereby yield a charge roller. The charge rollers were employed as samples 8 to 11.

TABLE 2

| | | | | S8 | S9 | S10 | S11 |
|---|---|---|---|---|---|---|---|
| Rubber composition (mass %) | | | Rubber base | 57.47 | 73.48 | 82.64 | 94.34 |
| | Additives | a | Conductivity-imparting agent | 1.84 | 0.66 | 8.93 | 2.64 |
| | | b | Inorganic filler | 37.36 | 24.25 | 4.38 | — |
| | | c | Vulcanizing agent & aid | 2.87 | 1.47 | 3.47 | 2.83 |
| | | d | Others | 0.46 | 0.15 | 0.58 | 0.19 |
| | Ratio of additives a, b, and d (mass %) | | | 39.66 | 25.06 | 13.88 | 2.83 |
| Surf. treatment liquid (mass %) | Isocyanate compound | | | 12.5 | 12.5 | 12.5 | 12.5 |
| | Organic solvent | | | 87.5 | 87.5 | 87.5 | 87.5 |
| Results | Elec. resistance $R_{before}$ (LogΩ) | | | 5.49 | 4.50 | 4.95 | 4.93 |
| | Elec. resistance $R_{after}$ (LogΩ) | | | 6.42 | 5.22 | 5.74 | 5.94 |
| | Difference $R_{a-b}$ (LogΩ) | | | 0.93 | 0.72 | 0.79 | 1.01 |
| | Impregnation depth (μm) | | | 150 | 120 | 80 | 50 |
| | Roller surface roughness Rz (μm) | | | 10.0 | 7.9 | 6.0 | 9.7 |
| | Elastic layer hardness (°) | | | 52 | 47 | 54 | 45 |
| | Compression set (%) | | | 16 | 18 | 20 | 12 |
| | Fogging | | | ○ | ○ | ○ | ○ |
| | Black line | | | X | X | X | ○ |
| | Uneven tint | | | ○ | ○ | ○ | ○ |
| | Processability (polishing, kneading) | | | ○ | ○ | ○ | Δ |

Sn: sample n

Samples 12 and 13

As shown in Table 3, the procedure of producing sample 1 was repeated, except that the roller surface roughness Rz was changed to 11.1 μm and 16.3 μm, respectively, to thereby yield charge rollers. The charge rollers were employed as samples 12 and 13.

Samples 14 to 16

As shown in Table 3, the procedure of producing sample 1 was repeated, except that the isocyanate compound content of the surface treatment liquid of sample 1 was changed to 20.0 mass %, 15.0 mass %, and 17.5 mass %, and the organic solvent content of the surface treatment liquid of sample 1 were changed to 80.0 mass %, 85.0 mass %, and 82.5 mass %, and the roller surface roughness Rz was changed to 12.4 μm, 12.3 μm, and 11.9 μm, to thereby yield charge rollers. The charge rollers were employed as samples 14 to 16.

TABLE 3

| | | | | S12 | S13 | S14 | S15 | S16 |
|---|---|---|---|---|---|---|---|---|
| Rubber composition (mass %) | | | Rubber base | 90.09 | 90.09 | 90.09 | 90.09 | 90.09 |
| | Additives | a | Conductivity-imparting agent | 2.52 | 2.52 | 2.52 | 2.52 | 2.52 |
| | | b | Inorganic filler | 4.50 | 4.50 | 4.50 | 4.50 | 4.50 |
| | | c | Vulcanizing agent & aid | 2.70 | 2.70 | 2.70 | 2.70 | 2.70 |
| | | d | Others | 0.18 | 0.18 | 0.18 | 0.18 | 0.18 |
| | Ratio of additives a, b, and d (mass %) | | | 7.21 | 7.21 | 7.21 | 7.21 | 7.21 |

TABLE 3-continued

| | | S12 | S13 | S14 | S15 | S16 |
|---|---|---|---|---|---|---|
| Surf. treatment liquid (mass %) | Isocyanate compound | 12.5 | 12.5 | 20.0 | 15.0 | 17.5 |
| | Organic solvent | 87.5 | 87.5 | 80.0 | 85.0 | 82.5 |
| Results | Elec. resistance $R_{before}$ (LogΩ) | 4.90 | 4.95 | 4.90 | 4.90 | 4.90 |
| | Elec. resistance $R_{after}$ (LogΩ) | 6.46 | 6.91 | 6.77 | 6.29 | 6.51 |
| | Difference $R_{a-b}$ (LogΩ) | 1.56 | 1.96 | 1.87 | 1.39 | 1.61 |
| | Impregnation depth (μm) | 60 | 60 | 60 | 60 | 60 |
| | Roller surface roughness Rz (μm) | 11.1 | 16.3 | 12.4 | 12.3 | 11.9 |
| | Elastic layer hardness (°) | 48 | 48 | 48 | 48 | 48 |
| | Compression set (%) | 10 | 10 | 10 | 10 | 10 |
| | Fogging | X | X | X | X | X |
| | Black line | ○ | ○ | ○ | ○ | ○ |
| | Uneven tint | ○ | ○ | ○ | ○ | ○ |
| | Processability (polishing, kneading) | ○ | ○ | ○ | ○ | ○ |

Sn: sample n

Samples 17 to 19

As shown in Table 4, the procedure of producing sample 1 was repeated, except that the isocyanate compound content of the surface treatment liquid of sample 1 was changed to 5.0 mass %, 5.0 mass %, and 35.0 mass %, and the organic solvent content of the surface treatment liquid of sample 1 was changed to 95.0 mass %, 95.0 mass %, and 65.0 mass %, and the roller surface roughness Rz was changed to 9.5 μm, 9.5 μm, and 9.8 μm, to thereby yield charge rollers. The charge rollers were employed as samples 17 to 19.

TABLE 4

| | | | | S17 | S18 | S19 |
|---|---|---|---|---|---|---|
| Rubber composition (mass %) | Rubber base | | | 90.09 | 90.09 | 90.09 |
| | Additives | a | Conductivity-imparting agent | 2.52 | 2.52 | 2.52 |
| | | b | Inorganic filler | 4.50 | 4.50 | 4.50 |
| | | c | Vulcanizing agent & aid | 2.70 | 2.70 | 2.70 |
| | | d | Others | 0.18 | 0.18 | 0.18 |
| Ratio of additives a, b, and d (mass %) | | | | 7.21 | 7.21 | 7.21 |
| Surf. treatment liquid (mass %) | Isocyanate compound | | | 5.0 | 5.0 | 35.0 |
| | Organic solvent | | | 95.0 | 95.0 | 65.0 |
| Results | Elec. resistance $R_{before}$ (LogΩ) | | | 4.90 | 4.90 | 4.90 |
| | Elec. resistance $R_{after}$ (LogΩ) | | | 5.17 | 5.36 | 7.85 |
| | Difference $R_{a-b}$ (LogΩ) | | | 0.27 | 0.46 | 2.95 |
| | Impregnation depth (μm) | | | 60 | 60 | 60 |
| | Roller surface roughness Rz (μm) | | | 9.5 | 9.5 | 9.8 |
| | Elastic layer hardness (°) | | | 48 | 48 | 48 |
| | Compression set (%) | | | 10 | 10 | 10 |
| | Fogging | | | ○ | ○ | ○ |
| | Black line | | | X | X | ○ |
| | Uneven tint | | | ○ | ○ | Δ |
| | Processability (polishing, kneading) | | | ○ | ○ | ○ |

Sn: sample n

Test Example 1

<Electric Resistance Measurement>

Figure 2:
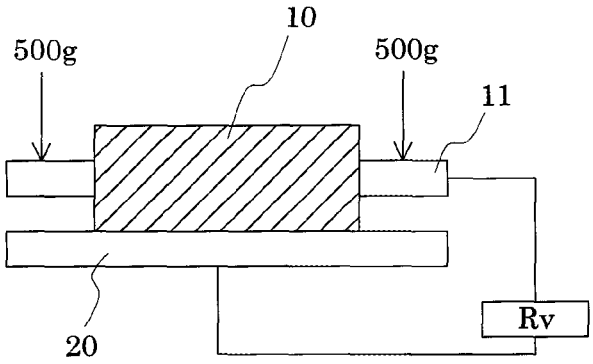
FIG. 2 is a sketch showing a method for measuring electric resistance.

FIG. 2 is a sketch showing a method for measuring electric resistance. As shown in FIG. 2, a charge roller 10 (samples 1 to 19) was placed on a metal roller 20 (ϕ: 30 mm). While a load (500 g) was applied to each end of the core 11, the charge roller was pressed against the metal roller. In this state, the metal roller 20 was rotated at 30 rpm, and a DC voltage of 100 V was applied for 10 seconds between the core 11 and the metal roller 20. The electric resistance (Ω) of the charge roller was measured before and after the surface treatment, and the difference in electric resistance (electric resistance difference) was calculated. Notably, electric resistance was measured by means of "ULTRA HIGH RESISTANCE METER R8340A" (product of Advantest Corp.).

In Test Example 1, common logarithmic values (Log Ω) of the electric resistance (Ω) of the charge roller before and after the surface treatment were obtained, and electric resistance difference $R_{a-b}$ (Log(Ω)) was calculated through the following formula (2):

$$R_{a-b}=R_{after}-R_{before} \quad (2)$$

(wherein $R_{before}$ represents a common logarithmic value (Log Ω) of the electric resistance (Ω) of the charge roller 10 before the surface treatment; and $R_{after}$ represents a common logarithmic value (Log Ω) of the electric resistance (Ω) of the charge roller 10 after the surface treatment). Tables 1 to 4 show the results.

Test Example 2

<Impregnation Depth Measurement>

The surface treatment liquid impregnation depth of each of samples 1 to 19 was determined. Tables 1 to 4 show the results. In a specific procedure, each sample was ground with an abrasive stone in a step-by-step manner. After completion of each grinding step, the surface was analyzed through infrared absorption spectrometry (IR) so as to detect the absorption attributed to an isocyanate compound. When the relevant peak disappeared, the amount of grinding (grind depth) was employed as the impregnation depth.

Test Example 3

<Roller Surface Roughness Measurement>

The roller surface roughness of each of samples 1 to 19 was measured after the surface treatment. Tables 1 to 4 show the results. In a specific procedure, the roller surface roughness Rz (μm) of each sample was measured by means of a surface roughness measuring instrument (SE3300, product of Kosaka Laboratory Ltd.) in accordance with "JIS B0601-1994 (ISO 4287 1997)." In the measurement, Rz was measured at 3 points (center and both ends) of the sample, and the measurements were averaged.

Test Example 4

<Measurement of Hardness of Elastic Layer>

The hardness (micro rubber hardness (°)) of the elastic layer of each of samples 1 to 19 was determined by means of a micro durometer (MD-1 capa, product of Kobunshi Keiki Co., Ltd.), after the surface treatment. Tables 1 to 4 show the results.

Test Example 5

<Compression Set Measurement>

The compression set (%) of each of samples 1 to 19 was measured (after 22 hours at 70° C. and 25% compression) in accordance with "JIS K6262" (ISO 0815-1). Tables 1 to 4 show the results.

Test Example 6

<Image Evaluation>

Each of samples 1 to 19 was attached to a charge-imparting member placed in a commercial laser beam printer. Through operation of the printer, an image was printed on a paper sheet. The image was evaluated in terms of fogging, black line, and uneveness in tint. Tables 1 to 4 show the results. The image evaluation was based on the following ratings.

Fogging was assessed by visually observing the state of a paper sheet and that of the same paper sheet after printing on white background and comparing the two states. The fogging status was evaluated with the following ratings: deposition of toner on white background (X); slight deposition (Δ); and no toner deposition (O).

Black line was assessed by visually observing the state of a paper sheet before printing and that of the same paper sheet after printing with a half-tone image, and comparing the two states. The black line status was evaluated with the following ratings: generation of black lines (X); slight generation of black lines (Δ); and no black line (O).

Unevenness in tint was assessed by visually observing the state of a paper sheet before printing and that of the same paper sheet after printing with a half-tone image, and comparing the two states. The uneven tint status was evaluated with the following ratings: presence of unevenness at charge roller pitches (X); slight unevenness (Δ); and no uneven tint (O).

Test Example 7

<Processability Evaluation>

In production of samples 1 to 19, processing properties (material kneadability and roller polishability) were evaluated in each case. Tables 1 to 4 show the results. The processability evaluation was based on the following ratings:

poor kneadability in production of the rubber composition, and poor polishability in polishing the roller product, failing to produce the product (X); difficulty in kneading and polishing (Δ); and no problem in in kneading and polishing (O).

Results

The aforementioned samples 1 to 7 had a ratio of the amounts of the processing aid, the conductivity-imparting agent, and the inorganic filler, based on the entire amount of the rubber composition, of 11 mass % or lower; a roller surface roughness Rz of 10 μm or less; a surface treatment liquid impregnation depth of 100 μm or lower; and a resistance difference $R_{a-b}$ of 0.60 Log Ω to 2.40 Log Ω. Each of the produced samples had a micro rubber hardness of 40° or greater and a compression set of 40% or less. Thus, no problem occurred in terms of processabilty of the rubber composition (e.g., kneadability or roller polishing property). Also, when each of the samples was employed in a printer, the obtained images had no image failures such as fogging, black line, and uneven tint.

The aforementioned samples 8 to 10 had a ratio of the amounts of the processing aid, the conductivity-imparting agent, and the inorganic filler, based on the entire amount of the rubber composition, in excess of 11 mass %. In the printed image evaluation, the samples provided black lines in the printed images. In particular, samples 8 and 9 exhibited a surface treatment liquid impregnation depth in excess of 100 μm. Thus, these samples were found to have poor durability.

Sample 11 exhibited a ratio of the amounts of the processing aid, the conductivity-imparting agent, and the inorganic filler of less than 3 mass %. However, no inorganic filler was added. Thus, kneadability of the rubber composition to form sample 11 was impaired, and poor roller polishing performance was attained. However, the obtained printed images were found to have no image failure.

Samples 12 to 16 exhibited a roller surface roughness Rz in excess of 10 μm. All of the samples provided toner deposition on white back ground in printed image evaluation, and also fogging.

Samples 17 to 19 had an isocyanate compound content, based on the entire amount of the surface treatment liquid, falling outside the range of 6 mass % to 34 mass %. Thus, the resistance difference $R_{a-b}$ fell outside the range of 0.60 Log Ω to 2.40 Log Ω. However, samples 17 and 18 exhibited an isocyanate compound content, based on the entire amount of the surface treatment liquid, less than 6 mass %. As a result, the resistance difference before and after the surface treatment was less than 0.60 Log Ω, and black lines were generated in the printed images, observed in image evaluation. Also, sample 19 had an isocyanate compound content, based on the entire amount of the surface treatment liquid, in excess of 34 mass %. As a result, the resistance difference before and after the surface treatment exceeded 2.40 Log Ω, and unevenness in tint was provided in the output images, observed in image evaluation.

The charge roller of the present invention is suitably employed as a charge roller for uniformly electrifying a photoreceptor or the like of an image-forming apparatus (e.g., a copying machine, a printer, or a facsimile (FAX)) of an electrophotographic DC electrification mode.

What is claimed is:

1. A charge roller to be employed in an image-forming apparatus of a DC electrification mode, the charge roller comprising a core, an elastic layer on the core, and a surface treatment layer on the surface of the elastic layer, wherein:

the elastic layer is formed of a vulcanization product of a rubber composition comprising a rubber base mainly containing an epichlorohydrin-based rubber, and additives including a conductivity-imparting agent, an inorganic filler, a vulcanization accelerator, and a vulcanizing agent;

the ratio of the amounts of the conductivity-imparting agent and the inorganic filler, based on the entire amount of the rubber composition, is 11 mass % or lower;

the surface treatment layer is formed by impregnating the elastic layer with a surface treatment liquid prepared by dissolving an isocyanate compound in an organic solvent; and the roller has a roller surface roughness Rz of 10 μm or less.

2. A charge roller according to claim 1, wherein the surface treatment layer has an impregnation depth of 100 μm or less, the impregnation depth being a depth of impregnation of the elastic layer with the surface treatment liquid after impregnation of the elastic layer with the surface treatment liquid.

3. A charge roller according to claim 2, wherein the elastic layer exhibits the difference in electric resistance of 0.60 Log Ω to 2.40 Log Ω, before and after a surface treatment with the surface treatment liquid.

4. A charge roller according to claim 3, wherein the ratio of the amounts of the conductivity-imparting agent and the inorganic filler, based on the entire amount of the rubber composition, is 3 mass % to 11 mass %.

5. A charge roller according to claim 2, wherein the ratio of the amounts of the conductivity-imparting agent and the inorganic filler, based on the entire amount of the rubber composition, is 3 mass % to 11 mass %.

6. A charge roller according to claim 1, wherein the ratio of the amounts of the conductivity-imparting agent and the inorganic filler, based on the entire amount of the rubber composition, is 3 mass % to 11 mass %.

* * * * *